US011388803B2

(12) United States Patent
Zhang

(10) Patent No.: US 11,388,803 B2
(45) Date of Patent: Jul. 12, 2022

(54) TRIAC DIMMING SYSTEM FOR LIGHTING DIMMING FUNCTION

(71) Applicant: NINGBO VEALITE ILLUMINATION CO., LTD, Ningbo (CN)

(72) Inventor: Maoyin Zhang, Ningbo (CN)

( * ) Notice: Subject to any disclaimer, the term of this patent is extended or adjusted under 35 U.S.C. 154(b) by 71 days.

(21) Appl. No.: 16/894,412

(22) Filed: Jun. 5, 2020

(65) Prior Publication Data

US 2021/0315082 A1 Oct. 7, 2021

(30) Foreign Application Priority Data

Apr. 3, 2020 (CN) ..... 202010260106.0

(51) Int. Cl.
*H05B 47/10* (2020.01)

(52) U.S. Cl.
CPC ..... *H05B 47/10* (2020.01)

(58) Field of Classification Search
CPC .... H05B 45/10; H05B 45/31; H05B 45/3725; H05B 45/3575; H05B 45/385; H05B 47/10; H05B 47/105; H05B 41/38; H05B 41/3924; H05B 41/3927; H05B 41/28289; H05B 41/2981; H05B 47/16; H05B 47/155; Y02B 20/30; Y02B 20/40; H02M 1/14; H02M 3/33507
See application file for complete search history.

(56) References Cited

U.S. PATENT DOCUMENTS

| | | | | |
|---|---|---|---|---|
| 5,559,395 | A * | 9/1996 | Venkitasubrahmanian | H05B 41/3921 315/307 |
| 5,872,429 | A * | 2/1999 | Xia | H05B 41/3921 315/194 |
| 7,872,427 | B2 * | 1/2011 | Scianna | H05B 45/3725 315/291 |
| 8,847,517 | B2 * | 9/2014 | Sutardja | H02M 3/33507 315/307 |
| 9,119,254 | B2 * | 8/2015 | Lee | H05B 45/10 |
| 9,131,581 | B1 * | 9/2015 | Hsia | H05B 45/375 |
| 9,769,901 | B1 * | 9/2017 | Vaughan | H05B 45/3725 |
| 10,531,531 | B2 * | 1/2020 | Wang | H05B 45/3575 |
| 10,856,395 | B1 * | 12/2020 | Jahan | G06N 3/08 |
| 2020/0107417 | A1 * | 4/2020 | Zhuang | H05B 45/31 |

* cited by examiner

*Primary Examiner* — Haissa Philogene
(74) *Attorney, Agent, or Firm* — Rumit Ranjit Kanakia

(57) ABSTRACT

A triac dimming system for lighting dimming function includes a triac dimming circuit and a zero-cross test unit. The zero-cross test unit connect with triac dimming circuit and pass the zero-cross signal to triac dimming circuit, then the main control center of triac dimming circuit will adjust the ON/OFF timing of triac dimming unit according to the zero-cross signal and the reserved amount to make the conduction angle of triac dimming circuit stable. After precisely controlling the brightness of the AC lamps, it can keep the AC load (AC lamps) flicker within the acceptable level of the user (no flicker feeling by the naked eye).

11 Claims, 12 Drawing Sheets

TRIAC DIMMING SYSTEM FOR LIGHTING DIMMING FUNCTION

TECHNICAL FIELD

The invention relates to the technical field of a lamps dimming system, in particularly, it is a triac dimming system for lighting dimming function.

TECHNOLOGY BACKGROUND

Triac dimmer has the function of dimming, and it is widely used in incandescent lamp and energy-saving lamp at present. Its working principle uses the waveform of input voltage to cut through the wave of triac, reduces the effective value of output voltage, and reduces the power of common load (resistance load). However, the triac dimming needs a maintain current to make it work. Otherwise it will return to the cut-off state. Generally, the maintain current in the range of several milliampere to dozens of milliampere, some even reach 50 milliampere. The greater the power generated, the greater the current to be maintained. Otherwise, if the maintain is insufficient, the conduction angle will be unstable, and the output waveform will be uneven, and there will be vibration and peak on the waveform. When such unstable output effect to lamps, there will be flicker. Therefore, how to overcome the flicker is an urgent technical problem currently.

SUMMARY OF THE INVENTION

The purpose of the invention is to design a triac dimming system for lighting dimming function to solve the shortage of above technology.

The triac dimming system designed by this invention includes a triac dimming circuit and a zero-cross test unit. The zero-cross test unit connect with triac dimming circuit and pass the zero-cross signal to triac dimming circuit, then the main control center of triac dimming circuit will adjust the ON/OFF timing of triac dimming unit according to the zero-cross signal and the reserved amount to make the conduction angle of triac dimming circuit stable.

According to the description of the triac dimming system, the feature is, this triac dimming system includes switch power supply, main control center unit, triac dimming control circuit, DC power supply control circuit, zero-cross test circuit and dimming control button unit. The main control center connects to triac dimming control circuit, switch power supply, zero-cross test circuit and dimming control button separately. The triac dimming control circuit connect to DC power supply circuit via rectified unit. The signal detection component of zero-cross test unit connects to triac and rectified unit. DC power supply control circuit connect to switch power supply.

According to the description of the triac dimming system, the feature is, it also can work with a buzzer which connect to the main control center unit.

According to the description of the triac dimming system, the feature is, it also includes a LED indicator array which connect to the main control center unit.

According to the description of the triac dimming system, the feature is, it also includes a D receiving unit which connect to the main control center unit.

According to the description of the triac dimming system, the feature is, it also includes a steady voltage circuit which build in switch power supply.

According to any description of the triac dimming system, the feature is, there is a Zener diode-Z1 build in the DC power supply control circuit. Zener diode-Z1 can protect the MOS-Q1.

A dimming method, the feature is, it includes an AC power network, an AC lamp which connect to AC power network and any triac dimming system. The triac dimming circuit connect to AC lamps and AC power network separately, the specific steps based on this implementation are as follows:

The zero-cross detection unit pass the real time detected zero-cross signal to triac dimming circuit, then the main control center unit of triac dimming circuit will adjust the ON/OFF timing of triac dimming unit according to the zero-cross signal and the reserved amount to make the conduction angle of triac dimming circuit stable.

According to the description of this dimming method, the specific steps 1) of triac dimming circuit are as follows:

a. Use the rectifier unit to obtain the AC power supply for the AC lamps, convert the AC power into DC power, then input to DC power supply circuit;

b. Use the DC power supply circuit to adjust the DC power, then output it to the switching power supply;

c. Use the switch power supply to convert the high-voltage DC power to low-voltage DC power, then output power to the main control unit;

d. According to the received dimming signal, the main control unit controls the ON/OFF of the triac control circuit to dimming the AC lamps;

According to the description of this dimming method, adopt step 1) to make the triac conduction angle output a stable waveform, the specific steps are as follows:

a1. Use the zero-cross detection unit to detect the zero crossing signal of AC power in real time;

b2, The main control unit adjusts the ON/OFF timing of traic control according to the AC zero-cross signal detected by the zero-cross detection unit and the reserved amount to make the triac conduction angle stable;

In addition, it also includes stabilizing the triac conduction angle when the AC power is at a fixed working frequency, or stabilizing the triac conduction angle when the AC power is at a variable working frequency;

In addition, the dimming signal is input to the main control unit by the control button, or the dimming signal is output by the wireless handheld terminal and input to the main control unit by the wireless receiving unit The triac dimming system for lighting dimming function in this invention, the main control unit was powered by the switch power supply, and control the ON/OFF of the triac to the control and adjust the AC power supply (to cut the AC wave and control the output waveform to make the triac conduction angle stable), and the MCU adjust the DC input from the switch power supply via control the ON/OFF of the MOS (The PWM adjust the DC to power the switch power, then the switch power lower the voltage and power other circuits to work), so as to precisely control the brightness adjustment of the working AC load (lamps) through the adjustment of both AC and DC, to make the flick rate acceptable of AC load (lamps) to users. (no flick feeling by the naked eye).

SPECIFIC IMPLEMENTATION

The technical scheme in this invention will be described with the illustrations as following. Also, Obviously, the described embodiments are only part of the invention, not all of them. Based on the embodiments in the invention, all other embodiments obtained by those skilled in this field belong to the protection scope of the invention.

Figure 1:
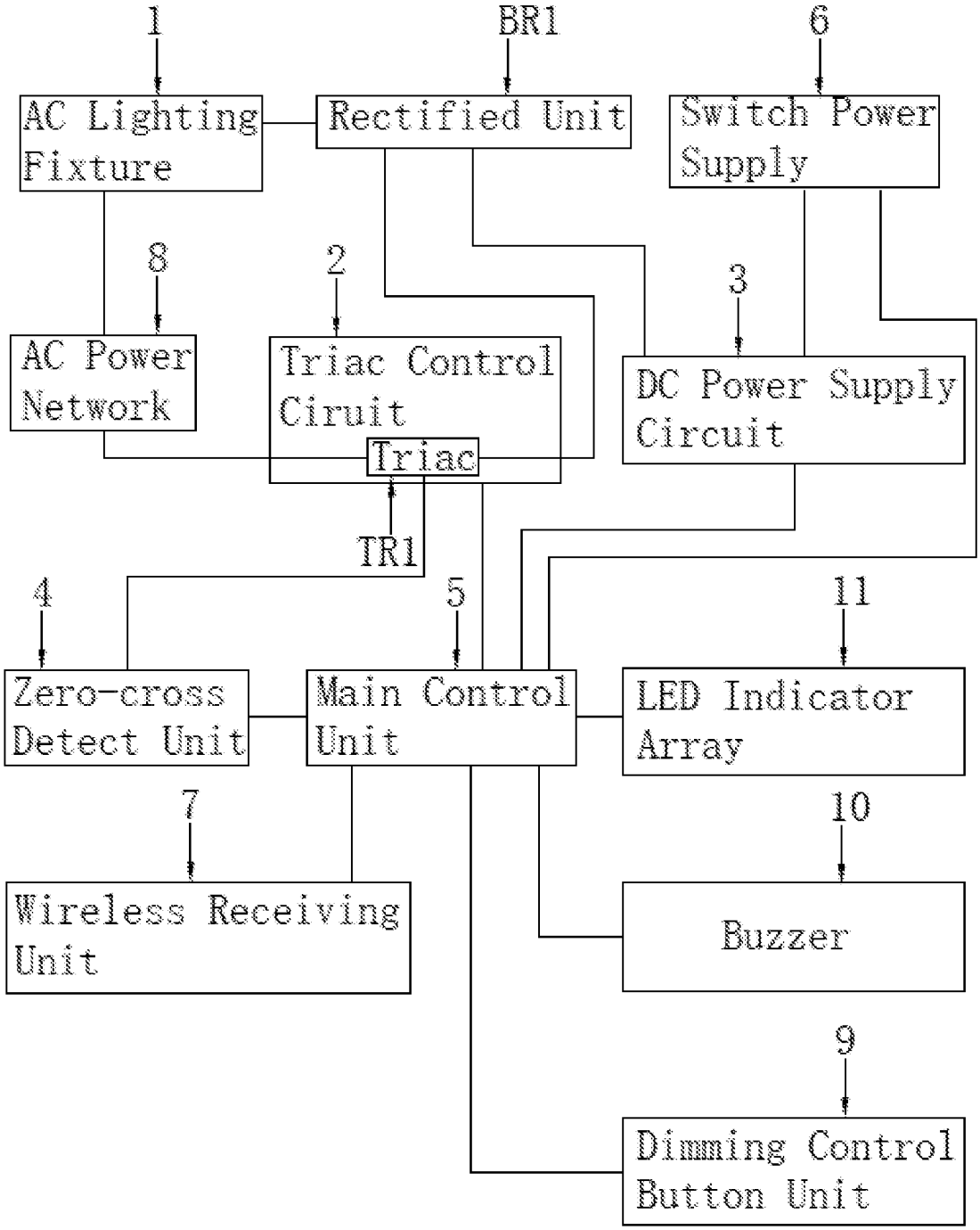
FIG. 1 is an overall framework of the embodiment.
Figure 2:
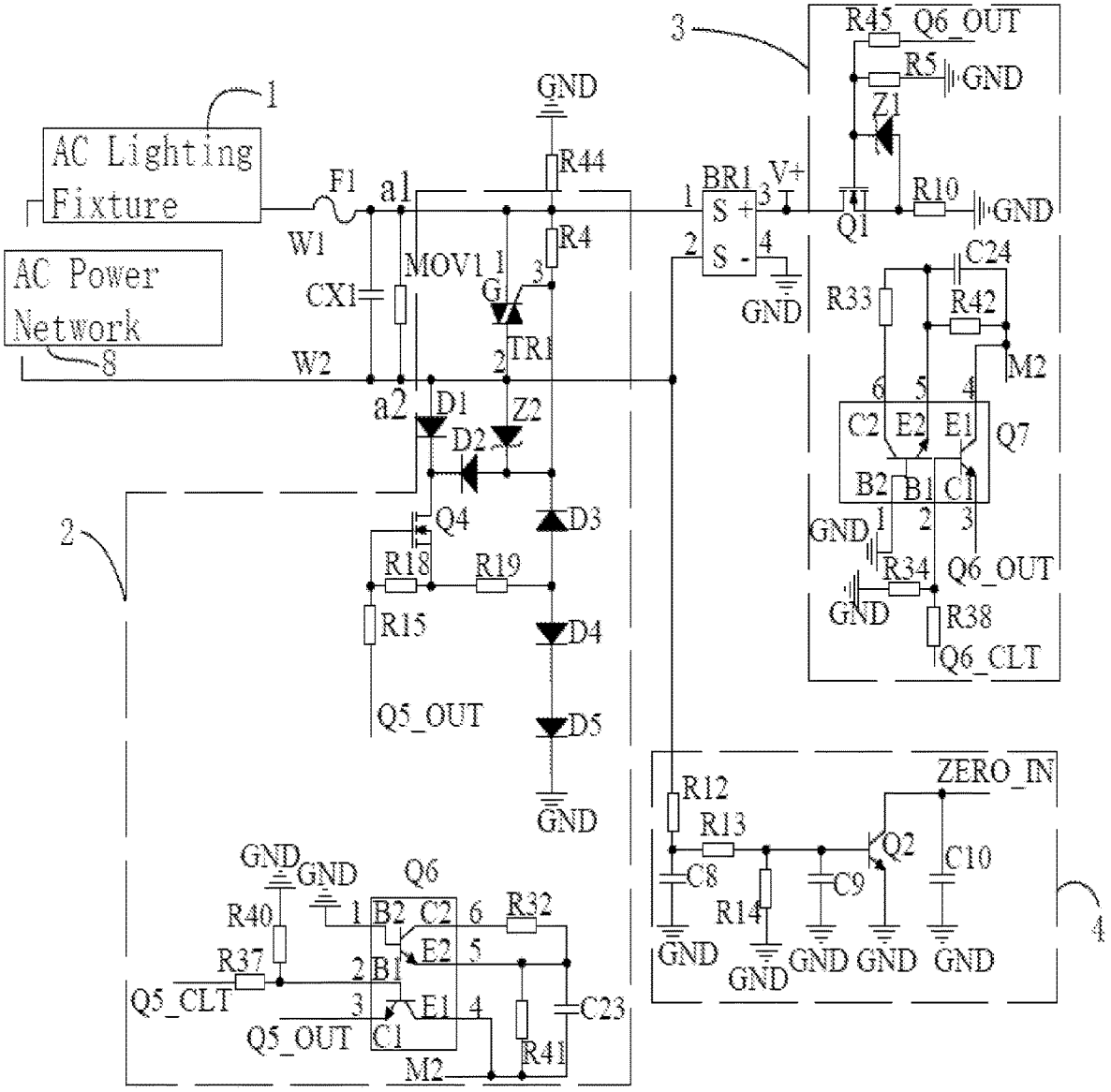
FIG. 2 is the DC power supply control circuit and Triac control circuit framework of the embodiment.
Figure 3:
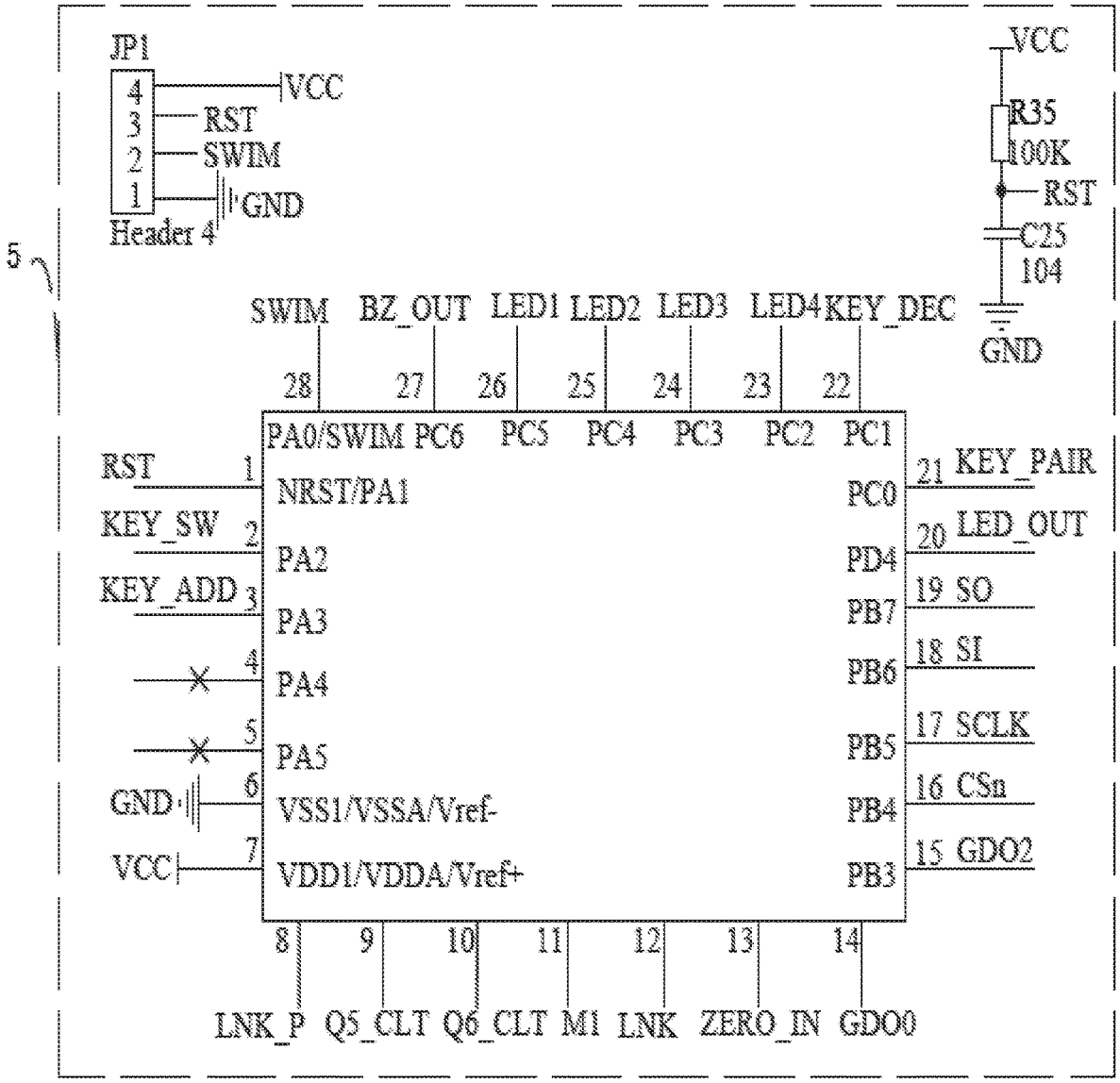
FIG. 3 is a main control unit framework of the embodiment.
Figure 4:
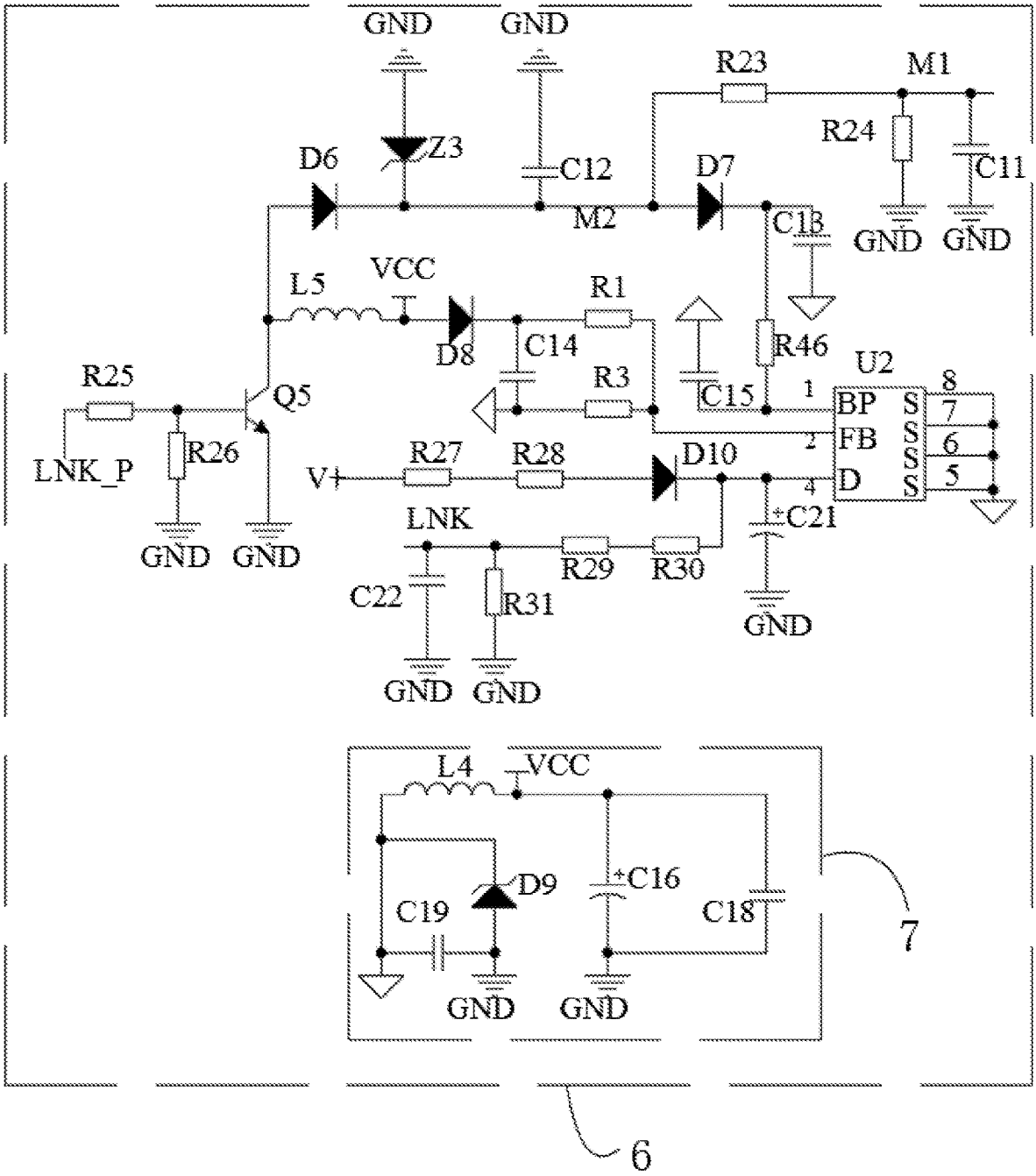
FIG. 4 is a switch power supply framework of the embodiment.
Figure 5:
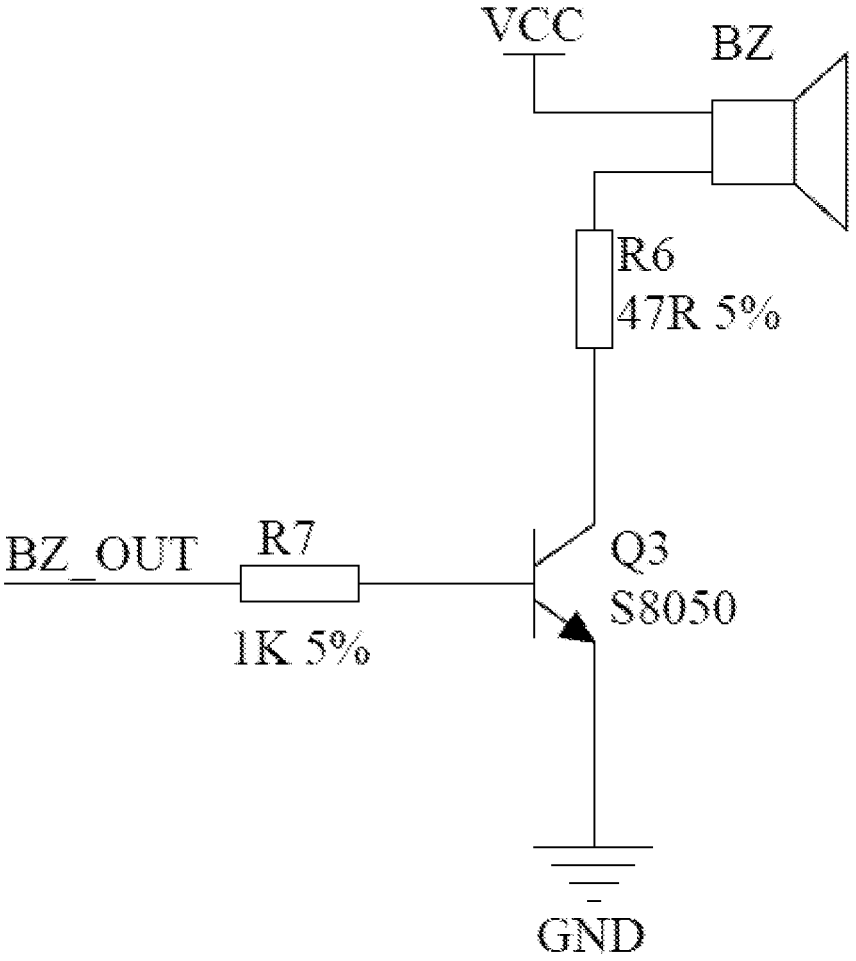
FIG. 5 is the buzzer framework of the embodiment.
Figure 6:
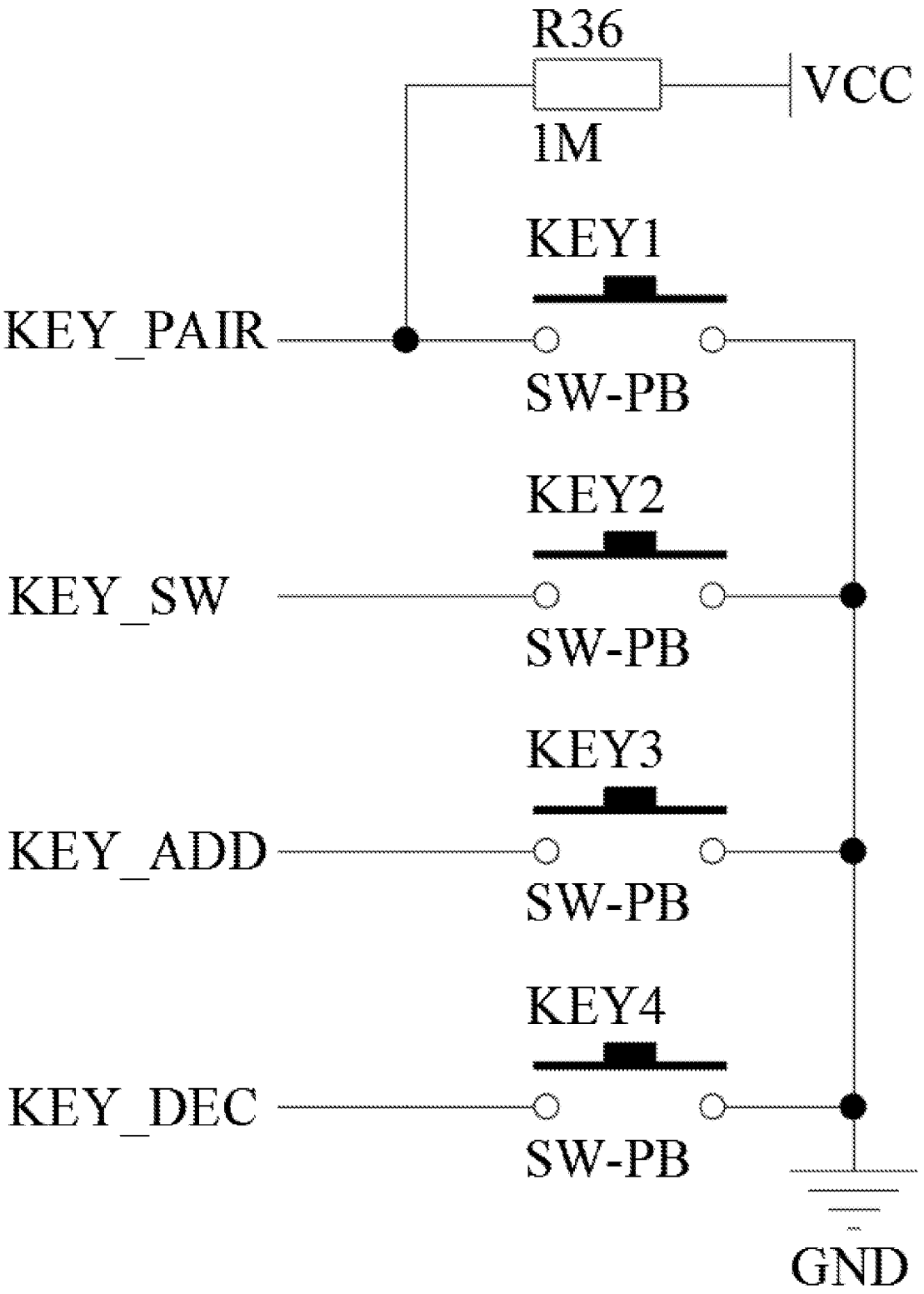
FIG. 6 is the control button framework of the embodiment.
Figure 7:
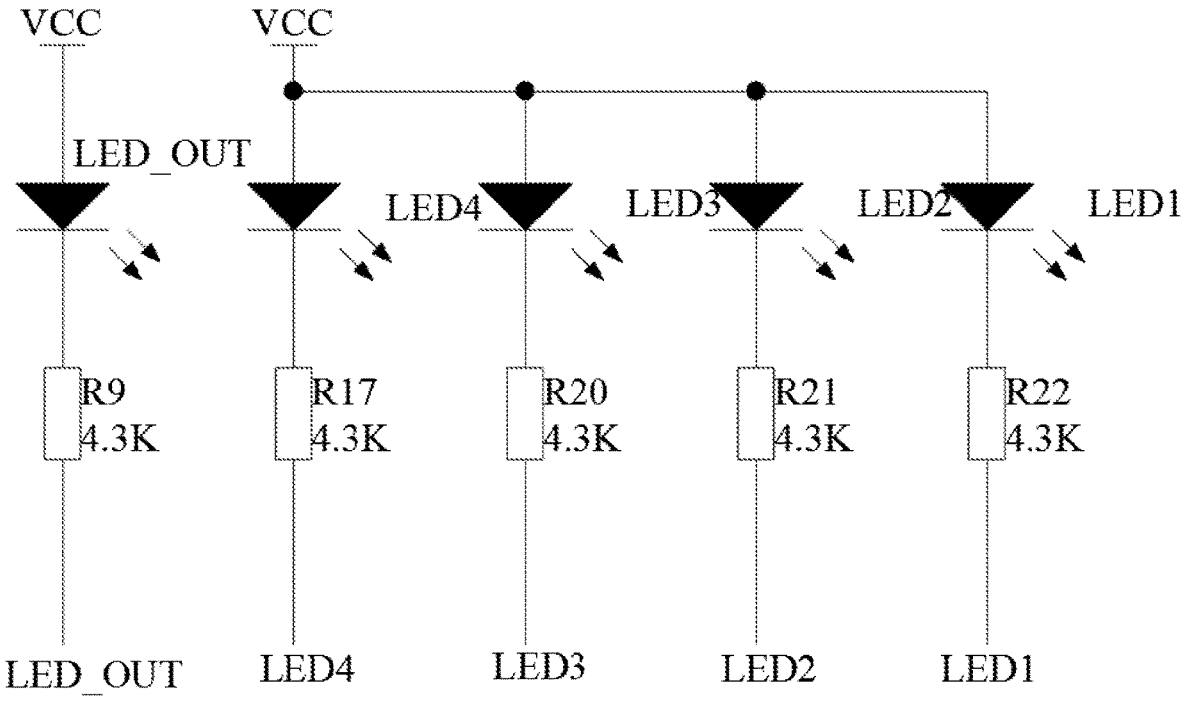
FIG. 7 is the LED indicator array framework of the embodiment.
Figure 8:
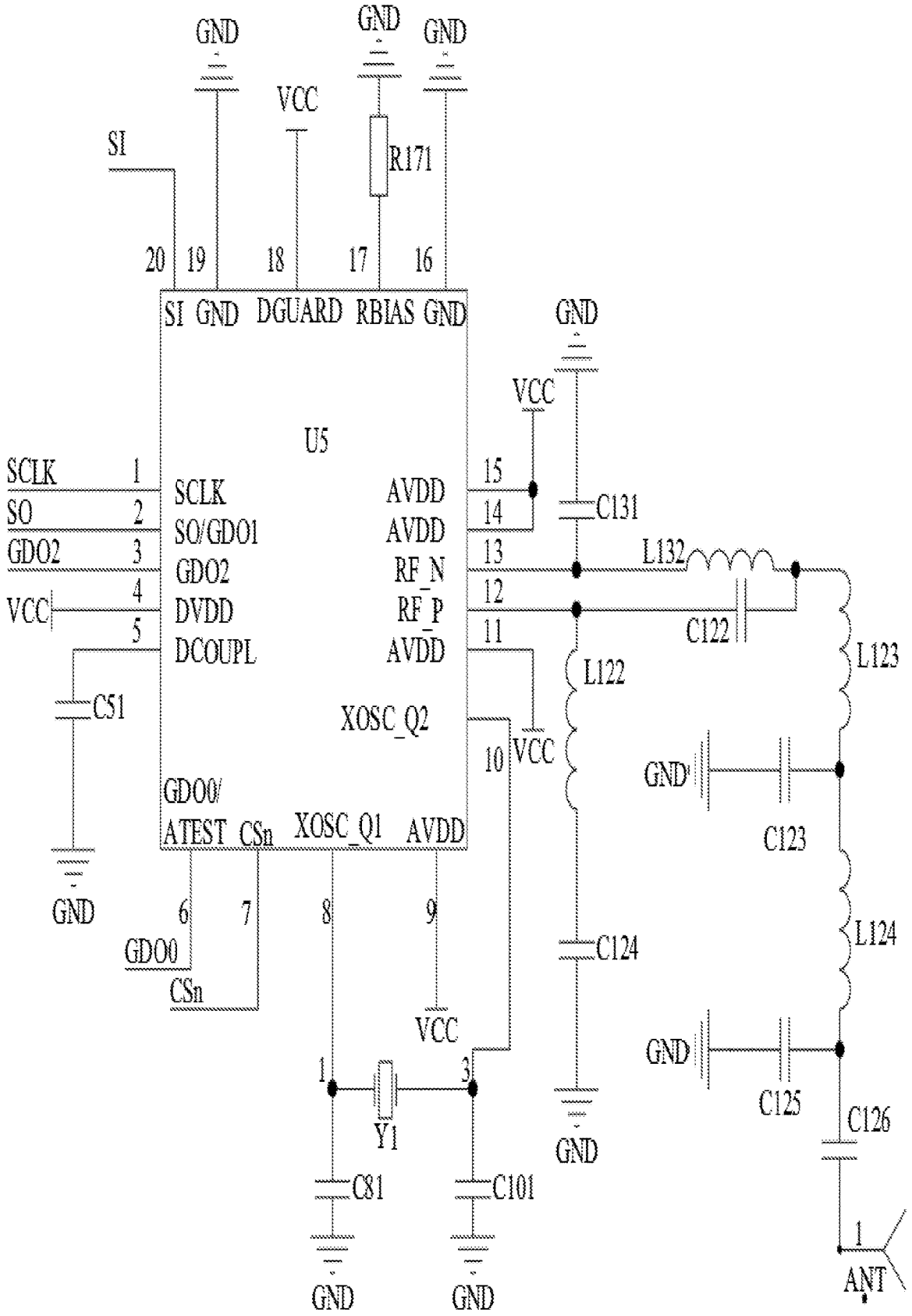
FIG. 8 is the wireless receiving unit framework of the embodiment.
Figure 9:
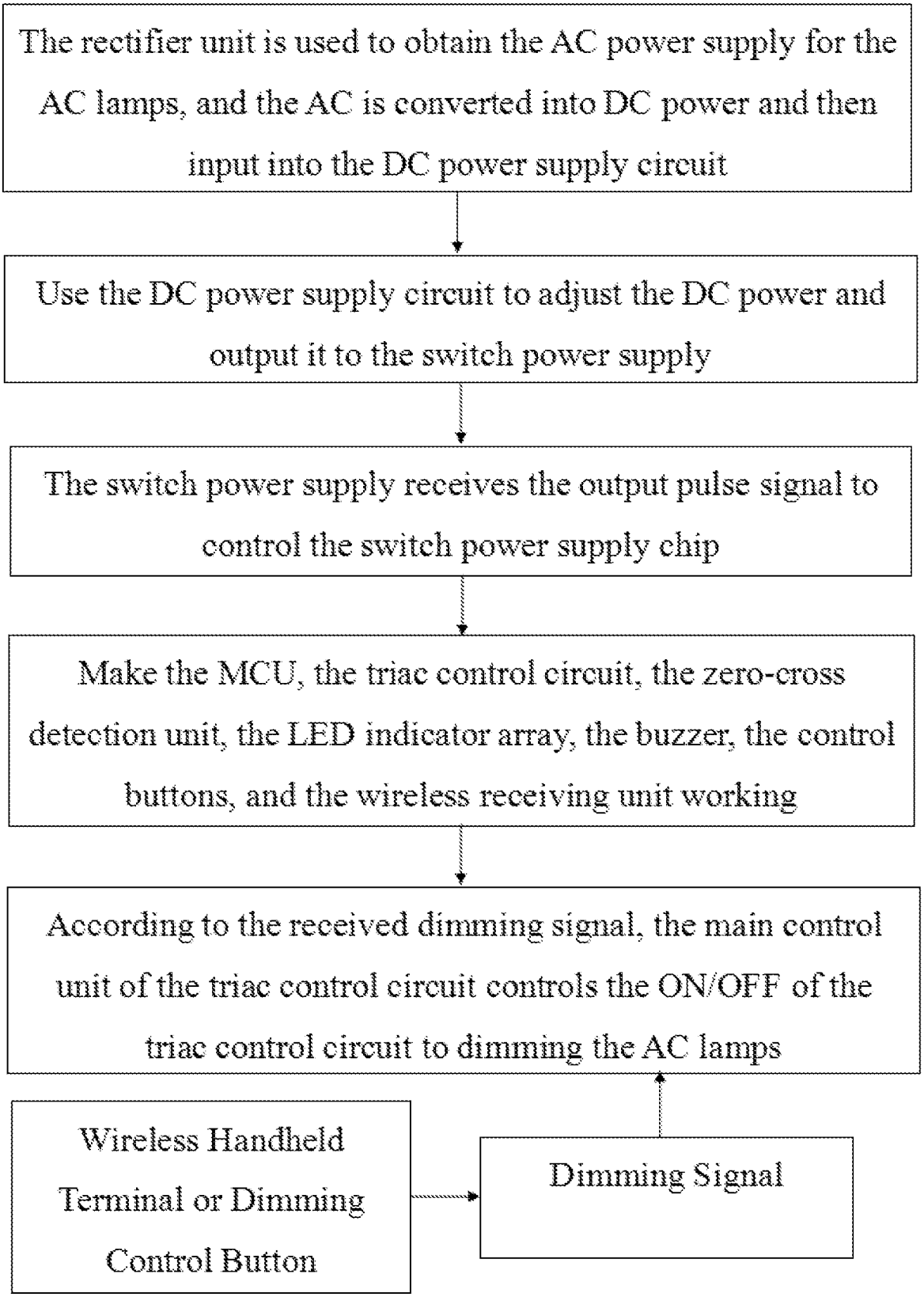
FIG. 9 is a flowchart of the dimming operation.
Figure 10:
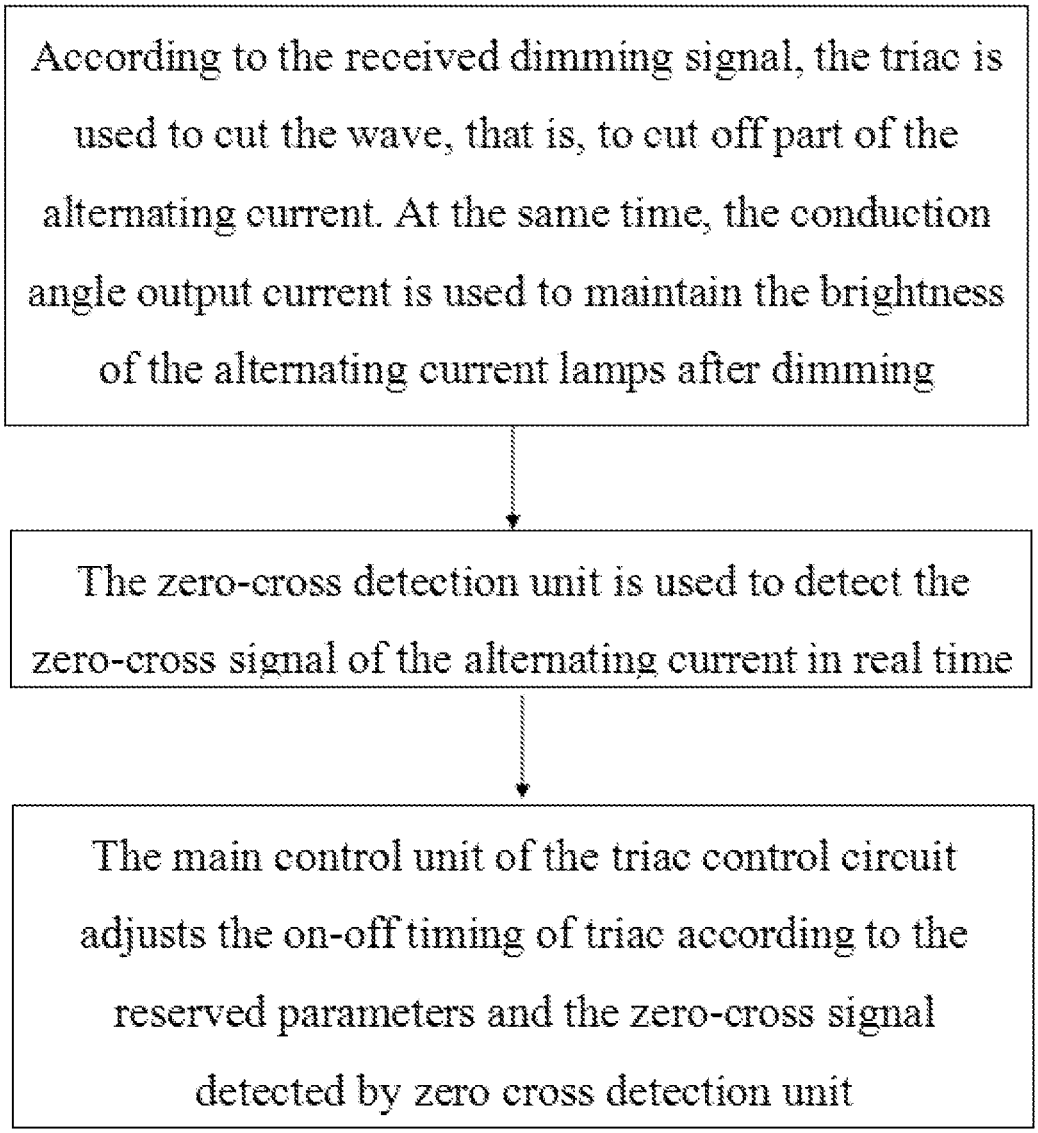
FIG. 10 is a dimming flowchart after the dimming operation is completed.
Figure 11:
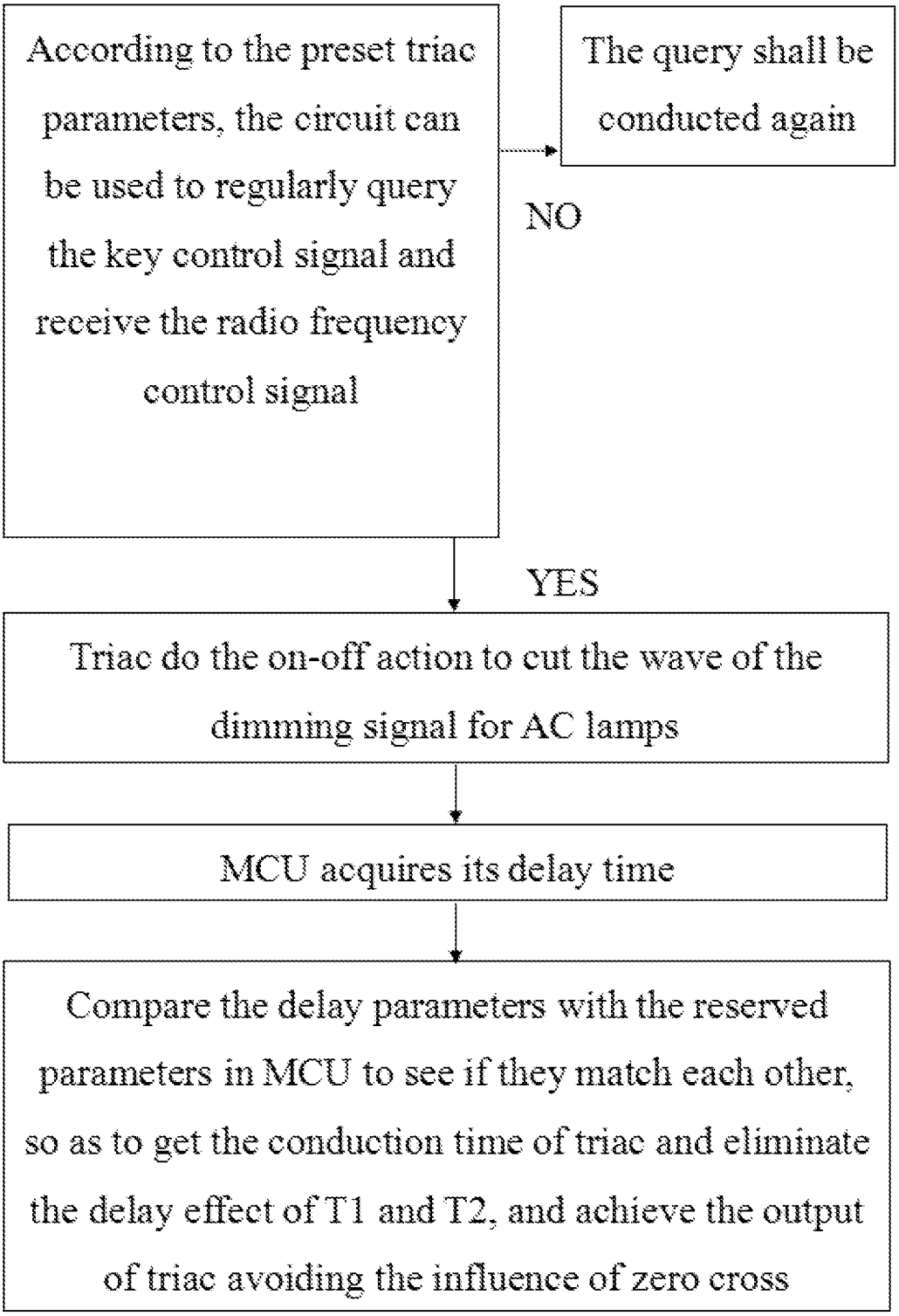
FIG. 11 is a dimming method flowchart of dimming the AC lamps when the AC working frequency is in a fixed state.
Figure 12:
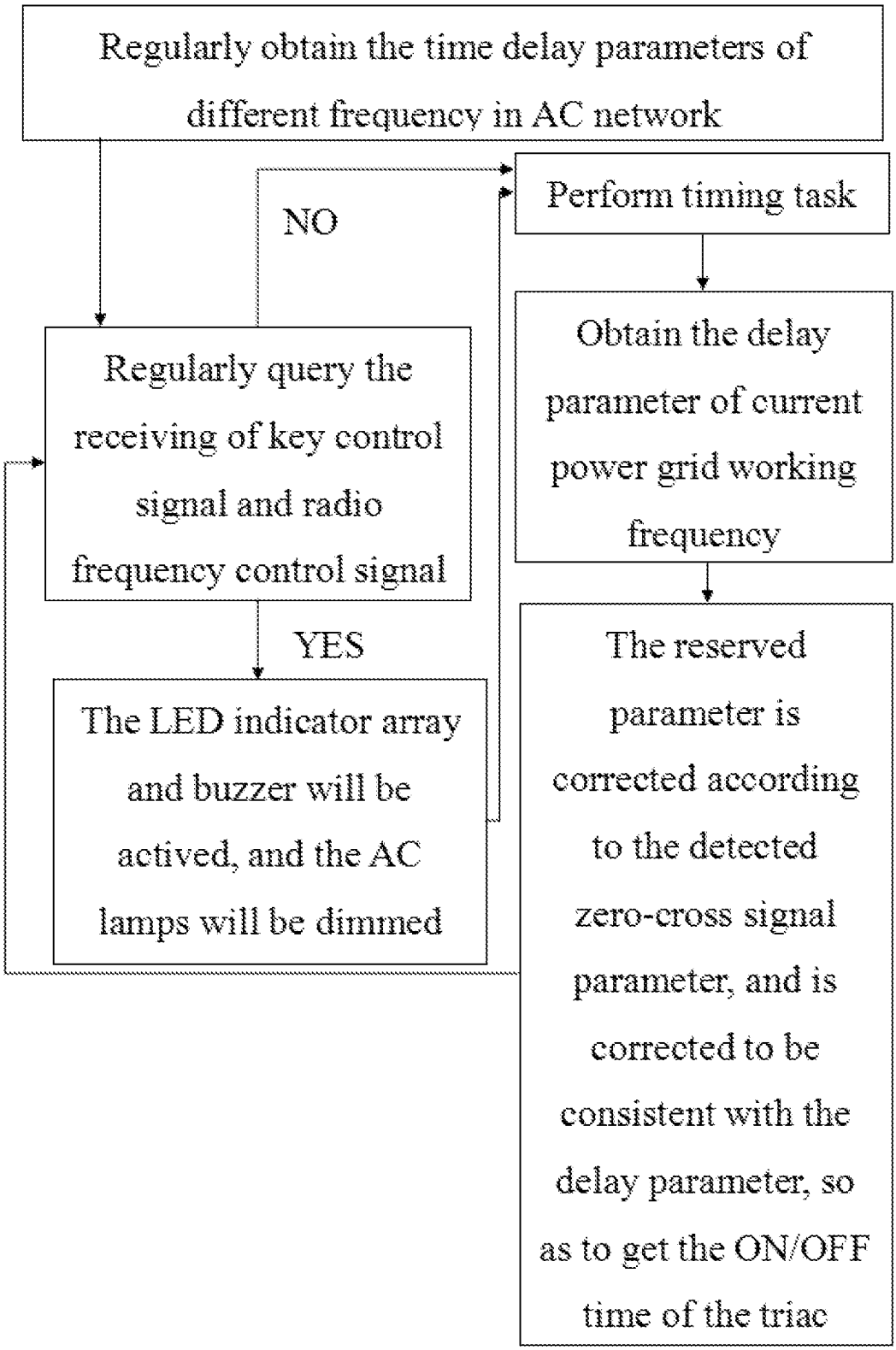
FIG. 12 is a dimming method flowchart of dimming the AC lamps when the AC working frequency is in a state of change.

As shown in FIGS. 1-7, the triac dimming system described in this invention includes a triac dimming circuit and a zero-cross detection unit (4) for dimming the powered lamps and fixtures. The zero-cross detection unit connect to the triac dimming circuit; The triac dimming circuit includes switch power supply (6), main control unit (5), triac control circuit (2), DC power supply circuit (3) and dimming control button unit (9). The main control center connects with triac dimming control circuit (2), switch power supply, zero-cross test circuit and dimming control button separately.

The Triac control circuit connect to DC power supply circuit via the rectified unit (BR1). The signal detection component of zero-cross test unit connects to triac and rectified unit. DC power supply control circuit connect to switch power supply. The zero-cross detection unit pass the real time detected zero-cross signal to triac dimming circuit, then the main control center unit of triac dimming circuit will adjust the ON/OFF timing of triac dimming unit according to the zero-cross signal and the reserved amount to make the conduction angle of triac dimming circuit stable.

In addition, the buzzer, LED indicator array and wireless receiving unit, all connect to the main control unit separately. The Buzzer and LED indicator array can offer corresponding feedback to end users based on the control actions.

In this invention, it also includes the steady voltage which build in the switch power supply to stable the DC voltage and make the whole system more reliable.

In this invention, there is a Zener diode-Z1 build in the DC power supply control circuit to protect the MOS-Q1 from breakdown due to strong interference.

In addition, based on the framework described on above, the TR1 in triac control circuit connect to AC power network and AC lamps, and the MCU in the main control unit can logic control the whole circuit via the preset program, so the AC lamps can be dimmed, more specified steps are as below:

The rectifier unit is used to obtain the AC power supply for the AC lamps, and the AC is converted into DC power and then input into the DC power supply circuit; Use the DC power supply circuit to adjust the DC power and output it to the switch power supply; The switch power supply receives the output pulse signal to control the switch power supply chip-U2, so as to lower the high-voltage direct current to the low-voltage direct current for output, and make the MCU, the triac control circuit, the zero-cross detection unit, the LED indicator array, the buzzer, the control buttons, and the wireless receiving unit working.

According to the received dimming signal, the main control unit controls the ON/OFF of the triac control circuit to dimming the AC lamps, and the dimming signal is generated and input to the main control unit after pressing the dimming control key (the up/down shift key for dimming). Or the dimming signal is output by the wireless handheld terminal and input to the main control unit through the wireless receiving unit.

In the dimming, the triac is used to cut the wave, that is, to cut off part of the alternating current. At the same time, the conduction angle output current is used to maintain the brightness of the alternating current lamps after dimming. At this time, the zero-cross detection unit is used to detect the zero-cross signal of the alternating current in real time. The main control unit adjusts the on-off timing of triac according to the reserved parameters and the zero-cross signal detected by zero cross detection unit.

Through the above dimming and the real-time corresponding adjustment of the on-off timing of the triac, the conduction angle output is maintained, and the waveform is stable, so as to control the flicker of the AC lamps, further making the flicker of the AC lamps after the dimming is not easy to occur, and the flicker of the AC lamps is within the acceptable level of the user (There is no flicker feeling with the naked eye); Among them, the MCU adjusts the DC of the input switch power supply through the ON/OFF of MOS-Q1.

Additionally, the diodes incorporated-Q6 and the diodes incorporated-Q7 in the circuit are composed of double triode and peripheral resistance capacitance. MCU controls the relative high voltage signal through the low voltage signal, supplies power to the switch power supply through the output of the diodes incorporated-Q7, controls the ON/OFF of the triac TR1 through the diodes incorporated-Q6, and the zero-cross detection unit obtains the zero-cross signal through the high and low level detection.

In this invention:

1. The method of this dimming system to control the flicker under the condition of AC constant frequency (the working frequency is fixed);

1) The delay time is t1 when the MCU obtain the zero-cross signal;

2) The delay time is t2 when the triac-TR1 cut the waves.

3) Based on the above specific logic control method: according to the preset triac parameters, the circuit can be used to regularly query the key control signal and receive the radio frequency control signal; If not found, the query shall be conducted again; if found, the LED indicator array and buzzer shall act, so as to control the on-off action of triac and to conduct dimming operation for AC lamps. At the same time, when the triac cut waves (dimming the lamps), the dimming key controls the on-off of MOS-Q1 and MOS-Q4, and then MCU acquires its delay time. Because the zero cross signal detected by the zero-cross detection unit will be changed according to the capacitance value after the wave cut, however, the reservation parameter will be changed according to the zero cross signal parameter detected by the zero cross detection unit, so the delay parameter will also be changed accordingly. Compare the delay parameters with the reserved parameters in MCU to see if they match each other, so as to get the conduction time of triac and eliminate the delay effect of T1 and T2, and achieve the output of triac avoiding the influence of zero cross and make the output waveform of triac conduction angle stable and eliminate flick.

2. The method of this dimming system to control the flicker under the condition of AC constant frequency (the working frequency is fixed); On the basis of the method of constant frequency dimming, the time delay parameters of different frequency in AC network are obtained by the program of constant frequency setting. Specifically, regularly query the receiving of dimming key control signal and radio frequency control signal; if not, perform timing task to obtain the delay parameter of current power grid working frequency. At the same time, based on the change of the working frequency of the power grid, the reserved parameter is corrected according to the detected zero-cross signal parameter, and is corrected to be consistent with the delay parameter, so as to get the ON/OFF time of the triac, and make the output waveform of the conduction angle of the triac stable and eliminate the flick. If found, the LED indicator array and buzzer will be actived, and the AC lamps will be dimmed. At this time, the timing task will be carried out to obtain the delay parameters of the current power grid working frequency. At the same time, based on the change of power grid working frequency, the reserved parameters will be corrected according to the detected zero cross signal parameters and the delay parameters will be consistent with each other, so as to get the ON/OFF time of the triac, and make the output waveform of the conduction angle of the triac stable and eliminate the flick. After the completion of parameter correction, the query task is resumed, so as to detect the parameters of the working frequency of the power grid circularly; thus, flick is controlled when the AC lamps are ON. (There is no flicker feeling with the naked eye)

The invention is not limited to the above best embodiments. Anyone can obtain other various forms of products under the Enlightenment of the invention. However, no matter any change is made in its shape or structure, any technical scheme which is the same or similar to the application falls within the protection scope of the invention.

The invention claimed is:

1. A triac dimming system for lighting dimming function, comprising:

a triac dimming circuit and a zero-cross test unit;

wherein the zero-cross test unit connects with the triac dimming circuit and passes a zero-cross signal to the triac dimming circuit, then a main control center unit of the triac dimming circuit adjusts an ON/OFF timing of the triac dimming circuit according to the zero-cross signal; wherein the system causes a conduction angle of the triac dimming circuit to be stable and eliminate flicker;

wherein the triac dimming circuit includes a switch power supply, said main control center unit, a triac dimming control circuit, a DC power supply control circuit, said zero-cross test unit and dimming control button unit wherein the main control center unit connects to the triac dimming control circuit, the switch power supply, the zero-cross test unit and the dimming control button unit separately; wherein the triac dimming control circuit connects to the DC power supply circuit via a rectified unit wherein a signal detection component of zero-cross test unit the connects to a triac of the triac dimming control circuit and the rectified unit and wherein the DC power supply control circuit connect to the switch power supply.

2. The triac dimming system according to claim 1, further comprising a buzzer which connects to the main control center unit.

3. The triac dimming system according to claim 2, further comprising a LED indicator array which connects to the main control center unit.

4. The triac dimming system according to claim 3, further comprising a wireless receiving unit which connects to the main control center unit.

5. The triac dimming system according to claim 4, further comprising an AC power network, and AC lamps which connect to the AC power network; wherein the triac dimming circuit connects to the AC lamps and the AC power network separately, wherein the triac dimming circuit performs functions including:

passing, via the zero-cross test unit, a real time detected zero-cross signal to the triac dimming circuit; and adjusting, via the main control center unit of the triac dimming circuit, the ON/OFF timing of the triac dimming circuit according to the zero-cross signal to make the conduction angle of the triac dimming circuit stable.

6. The triac dimming system according to claim 4, further comprising a steady voltage circuit which builds in the switch power supply.

7. The triac dimming system according to 6, further comprising a Zener diode-Z1 built in the DC power supply control circuit.

8. The triac dimming system according to claim 5, wherein the triac dimming circuit further performs functions including:

a. using the rectifier unit to obtain an AC power supply for the AC lamps by converting the AC power into DC power, then inputting it to the DC power supply circuit;

b. using the DC power supply circuit to adjust the DC power, then outputting it to the switching power supply;

c. using the switch power supply to convert a high-voltage DC power to a low-voltage DC power, then outputting it to the main control center unit;

d. according to a received dimming signal, controlling, via the main control center unit, the ON/OFF of the triac dimming control circuit to dim the AC lamps.

9. The triac dimming system according to claim 8, wherein the dimming signal is input to the main control center unit by the dimming control button unit, or the dimming signal is output by a wireless handheld terminal and input to the main control center unit by the wireless receiving unit.

10. The triac dimming system according to claim 8, wherein, to make the triac conduction angle output a stable waveform, the triac dimming circuit further performs functions including:

a1. using the zero-cross test unit to detect the zero crossing signal of the AC power in real time;

b2. adjusting, via the main control center unit, the ON/OFF timing of the triac dimming circuit according to the AC zero-cross signal detected by the zero-cross test unit to make the triac conduction angle stable.

11. The triac dimming system according to claim 10, wherein the triac dimming circuit further performs functions of stabilizing the triac conduction angle when the AC power is at a fixed working frequency, or stabilizing the triac conduction angle when the AC power is at a variable working frequency.

* * * * *